US005815847A

United States Patent [19]

Holden, Jr.

[11] Patent Number: 5,815,847

[45] Date of Patent: Oct. 6, 1998

[54] ONE SIZE FITS ALL BASEBALL BATTER'S HELMET

[75] Inventor: J. David Holden, Jr., Lunenburg, Mass.

[73] Assignee: AMPAC Enterprises, Inc., Shirley, Mass.

[21] Appl. No.: 880,435

[22] Filed: Jun. 23, 1997

[51] Int. Cl.[6] ..... A42B 3/10

[52] U.S. Cl. ..... 2/418; 2/414; 2/425

[58] Field of Search ..... 2/410, 411, 417, 2/418, 419, 420, 421, 425, 414

[56] References Cited

U.S. PATENT DOCUMENTS

| | | | |
|---|---|---|---|
| 1,725,425 | 8/1929 | Steingold . | |
| 1,894,213 | 1/1933 | Ostolaza . | |
| 2,455,797 | 12/1948 | Myers et al. . | |
| 2,739,310 | 3/1956 | Frieder et al. | 2/418 |
| 3,600,713 | 8/1971 | Holt . | |
| 3,787,894 | 1/1974 | Goodman, Jr. | 2/418 |
| 3,994,023 | 11/1976 | Aileo et al. . | |
| 4,713,844 | 12/1987 | Westgate . | |
| 5,012,533 | 5/1991 | Raffler | 2/420 |
| 5,142,705 | 9/1992 | Edwards . | |
| 5,315,718 | 5/1994 | Barson et al. | 2/418 |
| 5,381,560 | 1/1995 | Halstead | 2/421 |
| 5,511,250 | 4/1996 | Field et al. | 2/418 |
| 5,575,017 | 11/1996 | Hefling et al. . | |

FOREIGN PATENT DOCUMENTS

| | | |
|---|---|---|
| 0280042 | 1/1988 | European Pat. Off. . |

*Primary Examiner*—Michael A. Neas
*Attorney, Agent, or Firm*—Diller, Ramik & Wight, PC

[57] ABSTRACT

A batter's protective helmet includes a relatively rigid helmet or shell defined by a crown, front, rear and opposite side portions; and padding within the helmet for protecting the head of a user. The padding includes crown, front, opposite side and rear protective pad portions. A strap is provided for adjusting the overall size of the padding. The strap had end portions which project through openings in the rear portion of the helmet with each end portion carrying fasteners for fastening to a fastener carried by the helmet between the openings.

25 Claims, 2 Drawing Sheets

ONE SIZE FITS ALL BASEBALL BATTER'S HELMET

BACKGROUND OF THE INVENTION

The invention is directed to a protective helmet, specifically a baseball batter's helmet that can be adjusted to fit comfortably and snugly and, most importantly, to fit different head sizes of a wearer's head.

A typical adjustable protective helmet defined by a substantially rigid outer shell and an inner padding is disclosed in U.S. Pat. No. 5,511,250 granted on Apr. 30, 1996 to Field et al. The adjustment structure includes a flexible strap extending through circumferentially spaced slots in the shell to extend both inside of and outside of the shell with ends of the strap being adjustably overlapping secured to each other to establish desired helmet fit.

U.S. Pat. No. 5,142,705 granted on Sep. 1, 1992 to Edwards discloses another protective baseball helmet having an internal adjustable head band which includes an end projecting through a slot which can be secured by Velcro® fasteners to maintain head band adjustment.

The following prior art patents are representative of head band/hat/adjustment structures associated with both conventional and protective head gear:

| | |
|---|---|
| U.S. Pat. No. 1,725,425 | Steingold |
| U.S. Pat. No. 1,894,213 | Ostolaza |
| U.S. Pat. No. 2,455,797 | Myers et al. |
| U.S. Pat. No. 2,739,310 | Frieder et al. |
| U.S. Pat. No. 3,600,713 | Holt |
| U.S. Pat. No. 3,994,023 | Aileo et al. |
| U.S. Pat. No. 4,713,844 | Westgate |
| U.S. Pat. No. 5,012,533 | Raffler |
| U.S. Pat. No. 5,315,718 | Barson et al. |
| U.S. Pat. No. 5,381,560 | Halstead |
| U.S. Pat. No. 5,575,017 | Heffling et al. |
| European No. 0,280,042 | Raffler |

SUMMARY OF THE INVENTION

In accordance with the present invention, a relatively rigid outer helmet or shell is of a conventional construction except for having a pair of elongated slots or openings in a rear portion of the helmet. Within the helmet is protective padding defined by a front protective pad portion merging with side protective pad portions which in turn terminate short of and between which is a movable rear protective pad portion located adjacent a rear portion of the helmet or shell. A strap is adhered to the front and side protective pad portions and rear portions of the strap cross each other at an area between the rear portion of the helmet and the rear protective pad portion of the protective padding. End portions of the crossed rear strap portions project through the openings and carry first fastening means which cooperate with second fastening means carried by an exterior surface of the helmet rear portion between the openings. The end portions of the strap are pulled outwardly which causes the crossing rear strap portions to slide relative to each other and move the rear protective pad portion and the side protective pad portions toward an ever decreasing size, whereas opposite strap end portion movement increases the overall size of the padding, thus accommodating the protective helmet to batter's/wearer's heads of different sizes. Due to the utilization of two strap end portions and the symmetrical association thereof to the padding, the padding can be symmetrically tightened or loosened which not only assures proper sizing but also assures excellent fit and comfort.

Furthermore, since the strap end portions can be simultaneously pulled during tightening, the forces applied to the protective padding are applied thereto symmetrically which additionally assures proper sizing and comfort.

With the above and other objects in view that will hereinafter appear, the nature of the invention will be more clearly understood by reference to the following detailed description, the appended claims and the several views illustrated in the accompanying drawings.

DETAILED DESCRIPTION OF THE INVENTION

Figure 1:
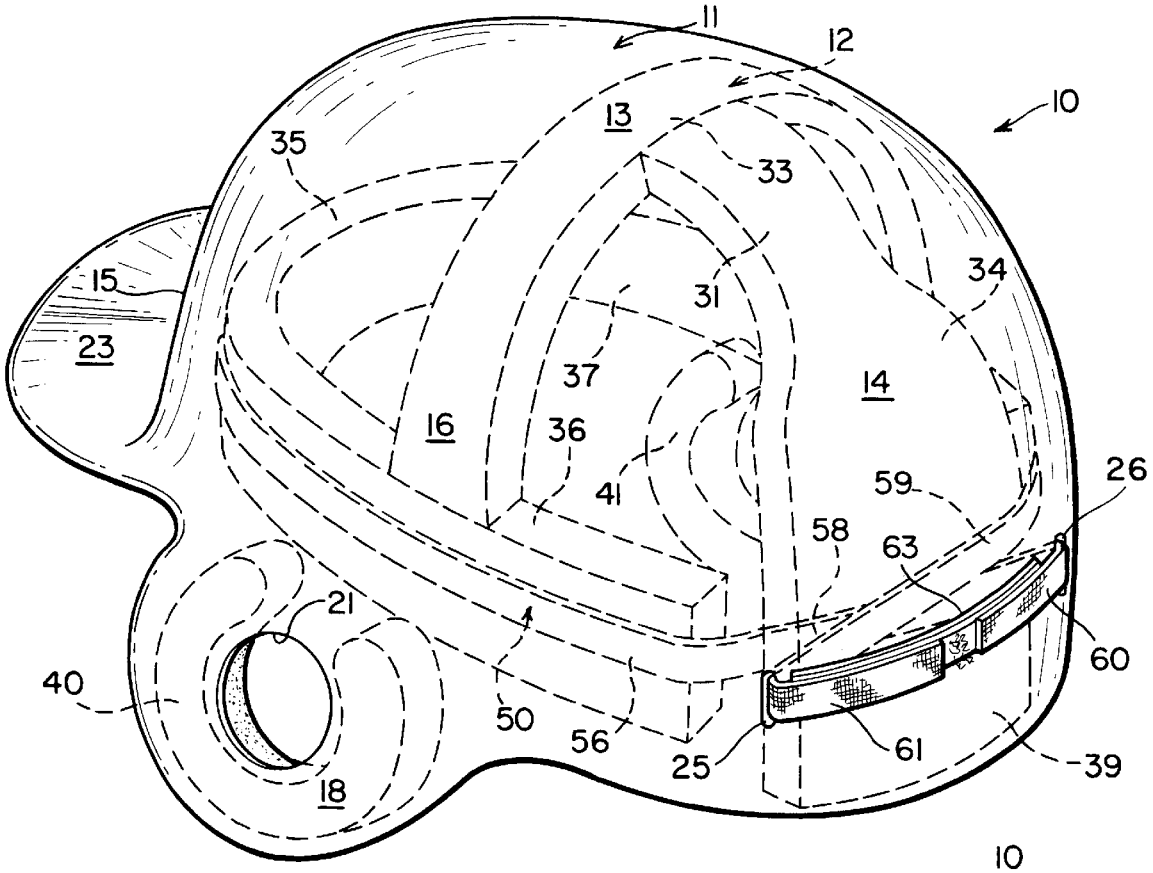
FIG. 1 is a rear perspective view of a novel batter's protective helmet of the invention, and illustrates internal protective padding and an associated strap having internally crossing rear strap portions and end strap portions projecting through helmet openings into overlying secured relationship to a fastening strip adhered to a rear portion of the helmet.

A novel batter's protective helmet constructed in accordance with this invention is generally designated by the reference numeral 10, and is defined by a relatively rigid helmet or shell 11 and interior protective padding or padding means 12.

The helmet or shell 11 of the protective helmet 10 includes a crown portion or crown 13, a rear portion 14, a front portion 15, opposite side portions 16, 17, each terminating in depending respective ear portions 18, 20 having respective circular ear holes 21, 22 and a visor or visor portion 23.

Figure 2:
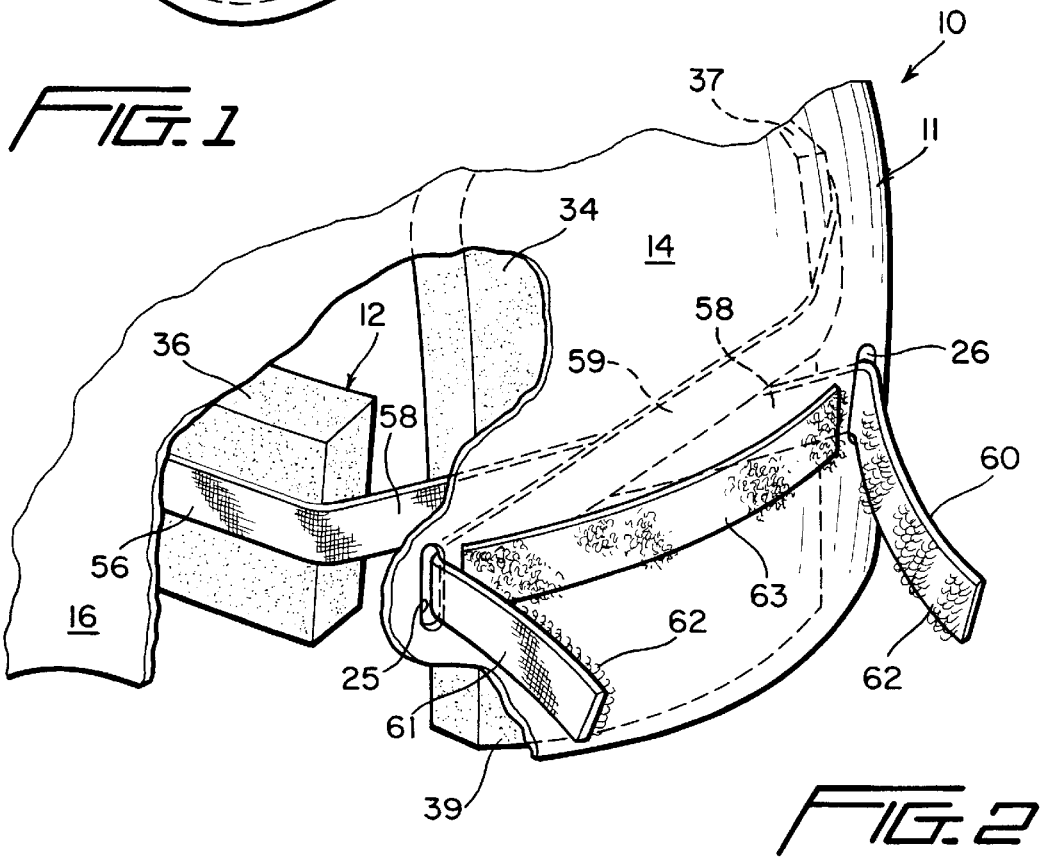
FIG. 2 is a fragmentary perspective view of a rear portion of the batter's protective helmet, and illustrates details thereof including Velcro® fastening means carried by the strap end portions and like Velcro® fastening means adhered to the helmet rear portion.

The helmet or shell 11 is of a conventional construction except for two relatively elongated substantially parallel openings or slots 25, 26 formed in the helmet rear portion 14, as is best illustrated in FIGS. I and 2 of the drawings. The protective padding or padding means 12 is formed from several pieces of relatively thick polymeric/copolymeric cushioning material, though the same can be formed as an integral one-piece construction. The protective padding 12 includes a crown protective pad portion 33 removably secured by Velcro ® fastening strips 27, 28 to an interior surface (unnumbered) of the crown portion 13 of the helmet 11. One fastening strip 27 is conventionally bonded to the crown protective pad portion 33 and the other fastening strip 28 is bonded to an interior surface (unnumbered) of the crown portion 13 of the element 11. The crown protective pad portion 33 blends with and is secured to opposite side protective pad portions 36, 37 which in turn merge with a front protective pad portion 35 adjacent the helmet front portion 15. A rear protective pad portion 34 includes an upper end 31 bonded to the crown protective pad portion 33 and to an inner surface of the helmet crown 13 while a lowermost rear protective pad portion 39 is relatively wide and is disposed between the side protective pad portions 36, 37, as is best illustrated in FIGS. 1 and 2 of the drawings.

Figure 3:
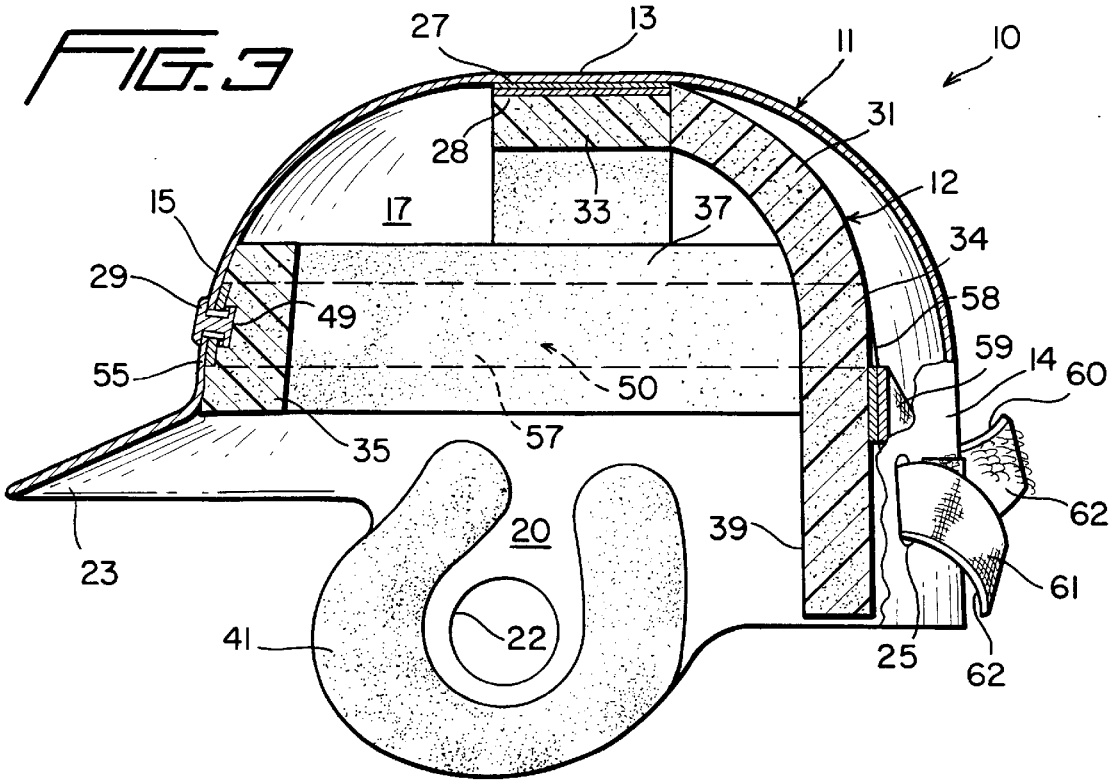
FIG. 3 is a longitudinal cross-sectional view taken through the protective helmet, and illustrates specifics of the protective padding and the strap including the manner in which the latter are secured to a front portion of the helmet.

Generally C-shaped upwardly opening protective pads 40, 41 are adhesively bonded to the respective ear portions 18, 20 (FIGS. 1 and 3, respectively) of the helmet 11. Strap means generally designated by the reference numeral 50 is provided for moving the rear protective pad portion 34 relative to the helmet rear portion 14 to variably adjust the overall size of the protective padding 12 to accommodate different sizes of user's heads. The strap means or strap 50 includes a front portion 55 and side portions 56, 57 adhesively bonded to the respective protective pad portions 35, 36 and 37 of the protective padding 12. A threaded bolt 29 (FIGS. 3 and 4) passes through an opening (unnumbered) in the front portion 15 of the helmet 11 and threads into a nut 49 sandwiched between the strap front portion 55 and the front pad portion 35. The strap or strap means 50 also includes rear strap portions 58, 59 which are integral extensions of the side strap portions 56, 57. The rear strap portions 58, 59 are in crossing relationship to each other exteriorly of the rear protective pad 34 and interiorly of the helmet rear portion 14. The rear strap portions 58, 59 terminate in respective strap end portions 60, 61 which project through the respective openings 25, 26. The strap end portions 60, 61 carry first fastening means 62 in the form of strips of Velcro® loop-type fastening means while a complementary second fastening means 63 in the form of complementary Velcro® type pile fastening means is bonded to the helmet rear portion 14 between the openings 25, 26.

Figure 4:
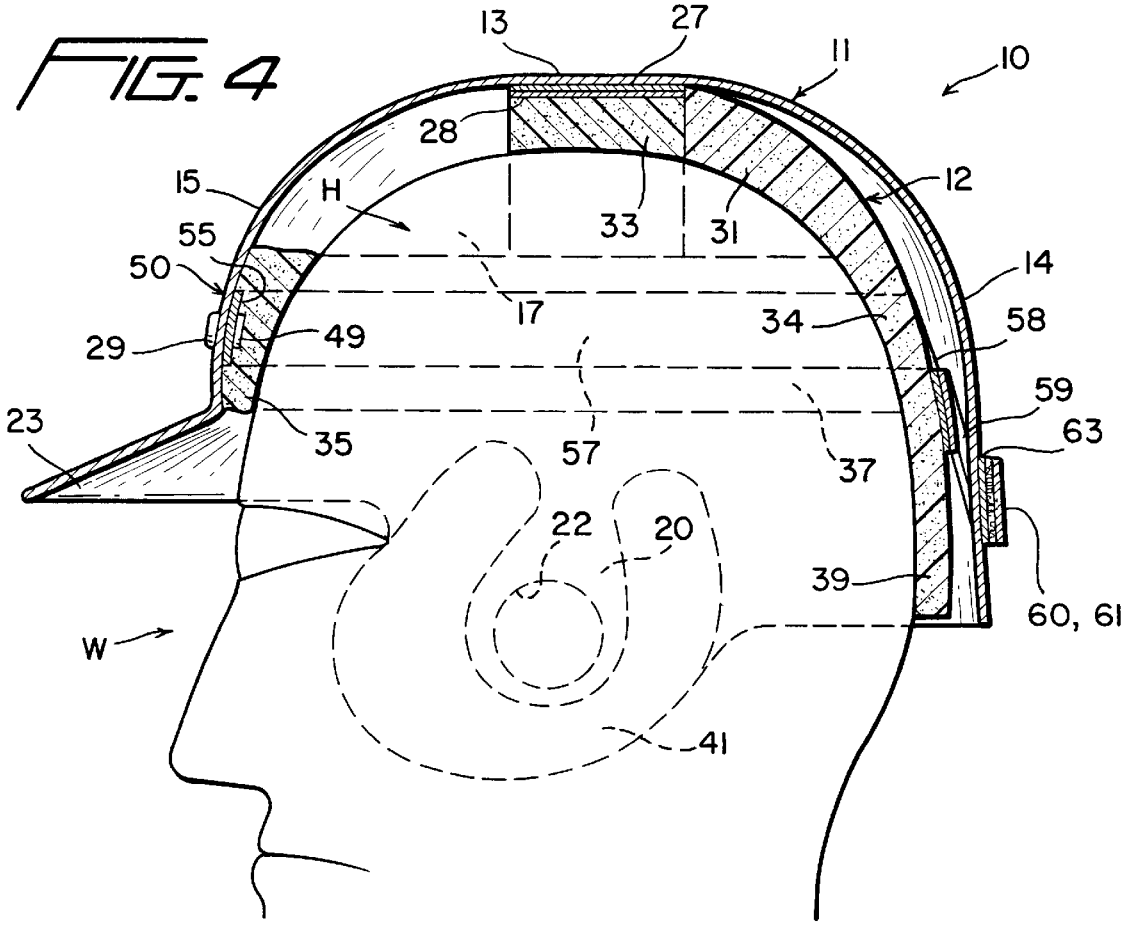
FIG. 4 is a cross-sectional view similar to FIG. 3, and illustrates the protective helmet in its adjusted position upon the head of a batter/wearer.

The protective helmet 10 is placed upon the head of a wearer by first making certain the fastening means 62, 63 are released (FIGS. 2 and 3), after which the user grasps the ear portions 18, 20 and/or the associated ear holes 21, 22, respectively, in a conventional manner to pull the protective helmet 10 down upon a head H of a wearer W (FIG. 4). The wearer W then grasps the strap end portions 60, 61 in his/her right and left hands, respectively, preferably between thumb and fingers, and pulls the strap end portion 60, 61 sideways away from each other in opposite directions thereby tightening the entire strap 50 which draws the rear protective pad portion 34 firmly against the wearer's head H and snugly urges the wearer's head H against the forward protective pad portion 35 and the side pad portions 36, 37, much in the manner diagrammatically illustrated in FIG. 4 of the drawings. Once the wearer W pulls the strap end portions 60, 61 sufficiently to assure the degree of snugness and comfort desired, the same are folded toward each other, generally simultaneously, to bring the fastening means 62, 62 into overlying fastening relationship to the fastening means 63, as is illustrated in FIG. 1 of the drawings. In this fashion the protective helmet 10 can be readily applied to and removed from the head of a wearer W in a rapid fashion while maintaining maximum comfort and safety.

Although a preferred embodiment of the invention has been specifically illustrated and described herein, it is to be understood that minor variations may be made in the apparatus without departing from the spirit and scope of the invention, as defined the appended claims.

What is claimed is:

1. A protective helmet comprising a helmet including crown, front, rear and opposite side portions; padding means in said helmet for protecting the head of a user, said padding means including a rear protective pad portion disposed substantially at said helmet rear portion, means for moving said rear protective pad portion relative to said helmet rear portion to variably adjust the overall size of said padding means to accommodate different sizes of user's heads, said moving means including strap means for selectively varying the position of the rear protective pad portion relative to the helmet rear portion, said strap means including a pair of rear strap portions in crossed relationship to each other within said helmet in contact with said rear protective pad portion, said strap means further including a pair of end strap portions each projecting through one of a pair of openings in said helmet, and each end strap portion having first fastening means for each fastening with second fastening means carried by an exterior surface of said helmet whereby any adjusted size of said padding means will be retained.

2. The protective helmet as defined in claim 1 wherein said rear strap portions are located between said rear protective pad and said helmet rear portion.

3. The protective helmet as defined in claim 1 wherein said second fastening means is located between said pair of openings.

4. The protective helmet as defined in claim 1 wherein said second fastening means is located between said pair of openings exteriorly of said helmet rear portion.

5. The protective helmet as defined in claim 1 wherein said second fastening means is located between said pair of openings, and means for securing said second fastening means to an exterior surface of said helmet rear portion.

6. The protective helmet as defined in claim 1 wherein said strap means includes a front strap portion sandwiched between a front protective pad portion of said padding means and said helmet front portion.

7. The protective helmet as defined in claim 1 wherein said strap means includes a front strap portion sandwiched between a front protective pad portion of said padding means and said helmet front portion, and means for securing said front strap portion and said front protective pad portion to said helmet front portion.

8. The protective helmet as defined in claim 1 wherein said strap means includes a front strap portion sandwiched between a front protective pad portion of said padding means and said helmet front portion, and means for removably securing said front strap portion and said front protective pad portion to said helmet front portion.

9. The protective helmet as defined in claim 1 wherein said padding means includes a front protective pad portion blending with opposite side protective pad portions, and said rear protective pad portion is located between and in spaced relationship to said protective pad portions.

10. The protective helmet as defined in claim 1 wherein said padding means includes a front protective pad portion blending with opposite side protective pad portions, said rear protective pad portion is located between and in spaced relationship to said protective pad portions, and said padding means further includes a crown protective pad portion spanning said helmet crown and merging with said side protective pad portions.

11. The protective helmet as defined in claim 1 wherein said padding means includes a front protective pad portion blending with opposite side protective pad portions, said rear protective pad portion is located between and in spaced relationship to said protective pad portions, said padding means further includes a crown protective pad portion spanning said helmet crown and merging with said side protective pad portions, said rear protective pad portion includes an upper end portion, and means for securing said rear protective pad portion upper end portion to said helmet.

12. A protective helmet comprising a helmet including crown, front, rear and opposite side portions; padding means in said helmet for protecting the head of a user, said padding means including a rear protective pad portion disposed substantially at said helmet rear portion, means for moving said rear protective pad portion relative to said helmet rear portion to variably adjust the overall size of said padding means to accommodate different sizes of user's heads, said moving means including strap means for selectively varying the position of the rear protective pad portion relative to the helmet rear portion, said strap means including a pair of rear strap portions crossing within said helmet adjacent said rear protective pad portion, said strap means further including a pair of end strap portions each projecting through one of a pair of openings in said helmet, and fastening means for fastening said end strap portions exteriorly of said helmet whereby any adjusted size of said padding means will be retained.

13. The protective helmet as defined in claim 12 wherein said strap means includes a front strap portion sandwiched between a front protective pad portion of said padding means and said helmet front portion.

14. The protective helmet as defined in claim 12 wherein said strap means includes a front strap portion sandwiched between a front protective pad portion of said padding means and said helmet front portion, and means for securing said front strap portion and said front protective pad portion to said helmet front portion.

15. The protective helmet as defined in claim 12 wherein said fastening means includes first fastening means carried by at least one of said end strap portions and second fastening means located between said pair of openings.

16. The protective helmet as defined in claim 15 wherein said strap means includes a front strap portion sandwiched between a front protective pad portion of said padding means and said helmet front portion.

17. The protective helmet as defined in claim 15 wherein said strap means includes a front strap portion sandwiched between a front protective pad portion of said padding means and said helmet front portion, and means for securing said front strap portion and said front protective pad portion to said helmet front portion.

18. A protective helmet comprising a helmet including crown, front, rear and opposite side portions; padding means in said helmet for protecting the head of a user, said padding means including a rear protective pad portion disposed substantially at said helmet rear portion, means for moving said rear protective pad portion relative to said helmet rear portion to variably adjust the overall size of said padding means to accommodate different sizes of user's heads, said moving means including strap means for selectively varying the position of the rear protective pad portion relative to the helmet rear portion, said strap means including a rear strap portion within said helmet in contact with said rear protective pad portion, said strap means further including a pair of end strap portions each projecting through one of a pair of openings in said helmet, each end strap portion having first fastening means for each fastening with second fastening means carried by an exterior surface of said helmet whereby any adjusted size of said padding means will be retained, said strap means including a front strap portion sandwiched between a front protective pad portion of said padding means and said helmet front portion, and said means for securing said front strap portion and said front protective pad portion to said helmet front portion.

19. A protective helmet comprising a helmet including crown, front, rear and opposite side portions; padding means in said helmet for protecting the head of a user, said padding means including a rear protective pad portion disposed substantially at said helmet rear portion, means for moving said rear protective pad portion relative to said helmet rear portion to variably adjust the overall size of said padding means to accommodate different sizes of user's heads, said moving means including strap means for selectively varying the position of the rear protective pad portion relative to the helmet rear portion, said strap means including a rear strap portion within said helmet in contact with said rear protective pad portion, said strap means further including a pair of end strap portions each projecting through one of a pair of openings in said helmet, each end strap portion having first fastening means for each fastening with second fastening means carried by an exterior surface of said helmet whereby any adjusted size of said padding means will be retained, said strap means including a front strap portion sandwiched between a front protective pad portion of said padding means and said helmet front portion, and means for removably securing said front strap portion and said front protective pad portion to said helmet front portion.

20. A protective helmet comprising a helmet including crown, front, rear and opposite side portions; padding means in said helmet for protecting the head of a user, said padding means including a rear protective pad portion disposed substantially at said helmet rear portion, means for moving said rear protective pad portion relative to said helmet rear portion to variably adjust the overall size of said padding means to accommodate different sizes of user's heads, said moving means including strap means for selectively varying the position of the rear protective pad portion relative to the helmet rear portion, said strap means including a pair of rear strap portions crossing within said helmet adjacent said rear protective pad portion, said strap means further including a pair of end strap portions each projecting through at least one opening in said helmet, and fastening means for fastening said end strap portions exteriorly of said helmet whereby any adjusted size of said padding means will be retained.

21. The protective helmet as defined in claim 20 wherein said strap means includes a front strap portion sandwiched between a front protective pad portion of said padding means and said helmet front portion.

22. The protective helmet as defined in claim 20 wherein said strap means includes a front strap portion sandwiched between a front protective pad portion of said padding means and said helmet front portion, and means for securing said front strap portion and said front protective pad portion to said helmet front portion.

23. The protective helmet as defined in claim 20 wherein said fastening means includes first fastening means carried by at least one of said end strap portions and second fastening means located between said pair of openings.

24. The protective helmet as defined in claim 23 wherein said strap means includes a front strap portion sandwiched between a front protective pad portion of said padding means and said helmet front portion.

25. The protective helmet as defined in claim 23 wherein said strap means includes a front strap portion sandwiched between a front protective pad portion of said padding means and said helmet front portion, and means for securing said front strap portion and said front protective pad portion to said helmet front portion.

* * * * *